United States Patent [19]

Pickering

[11] Patent Number: 4,476,850

[45] Date of Patent: Oct. 16, 1984

[54] NOISE REDUCING HEAT EXCHANGER ASSEMBLY FOR A COMBUSTION SYSTEM

[75] Inventor: Mark A. Pickering, Lebanon, Ind.

[73] Assignee: Carrier Corporation, Syracuse, N.Y.

[21] Appl. No.: 414,143

[22] Filed: Sep. 2, 1982

[51] Int. Cl.[3] ..... F23D 13/20

[52] U.S. Cl. ..... 126/112; 165/135; 431/114; 126/99 A

[58] Field of Search ..... 126/110 C, 110 R, 110 A, 126/112, 116 R, 116 A, 91 A, 99 D, 99 A; 431/114, 159; 165/135

[56] References Cited

U.S. PATENT DOCUMENTS

| | | | |
|---|---|---|---|
| 1,927,174 | 9/1933 | Jones | 126/116 R |
| 2,012,794 | 8/1935 | Williams et al. . | |
| 2,154,133 | 4/1939 | McIlvaine . | |
| 2,658,504 | 11/1953 | Jaye et al. | 126/116 R |
| 2,670,034 | 2/1954 | Thompson . | |
| 2,676,649 | 4/1954 | Diehl et al. | 431/114 X |
| 2,887,074 | 5/1959 | Friedberg | 126/19 A X |
| 3,087,532 | 4/1963 | Beach et al. . | |
| 3,394,695 | 7/1968 | Boden | 126/116 R X |
| 3,670,713 | 6/1972 | Abbott | 126/91 A X |
| 4,006,728 | 2/1977 | Nisli et al. | 126/116 R X |
| 4,168,948 | 9/1979 | Okamoto . | |
| 4,383,824 | 5/1983 | Findlay et al. | 126/110 C X |

*Primary Examiner*—Samuel Scott
*Assistant Examiner*—Carl D. Price
*Attorney, Agent, or Firm*—David L. Adour

[57] ABSTRACT

A noise reducing heat exchanger assembly for a combustion system is disclosed. The heat exchanger assembly includes a plurality of side by side heat exchangers each having a single inlet for an inshot burner. An auxiliary port is located just above each burner inlet. A coupling chamber may be used to interconnect the auxiliary ports to allow acoustical coupling between the heat exchangers and to substantially prevent potential fluid flow between the heat exchangers and the surroundings of the combustion system. This heat exchanger assembly is particularly suitable for use as part of an induced draft combustion furnace.

3 Claims, 4 Drawing Figures

NOISE REDUCING HEAT EXCHANGER ASSEMBLY FOR A COMBUSTION SYSTEM

BACKGROUND OF THE INVENTION

The present invention relates to combustion systems, and more particularly relates to heat exchangers for combustion systems.

Combustion systems, such as combustion furnaces, generate sounds which, depending on the use and environment of the combustion system, may be unacceptable or unpleasant. The sound level generated by a particular combustion system generally depends on the turbulence of the combustion fluids at the source of combustion. In addition, these sounds may interact with structural components of the combustion system which acoustically amplify the sound. Normally, in combustion furnaces this sound level is reduced to an acceptable level by adjusting the flow of the combustion fluids to maintain a substantially non-turbulent flow at the combustion source, and by arranging the heat exchanger assembly, furnace cabinet, and other such components to minimize acoustic amplification. However, in certain situations it is not feasible or desirable to reduce the sound level by using these conventional techniques. Also, it may be desirable to reduce the sound level to a level lower then that which may be attained by using these conventional techniques. For example, in an induced draft combustion furnace having compact, side by side heat exchangers with monoport, inshot burners, it is not desirable to make burner modifications which may decrease the efficiency of the furnace and it is not desirable to make other furnace component modifications which may increase the size and/or bulkiness of the furnace.

SUMMARY OF THE INVENTION

Therefore, an object of the present invention is to reduce the sound level generated by a combustion system.

Another object of the present invention is to reduce the sound level generated by a combustion system without substantially affecting the efficiency or component arrangement of the system.

A further object of the present invention is to reduce the sound level generated by an induced draft combustion furnace having compact, side by side heat exchangers with monoport, inshot burners, without substantially affecting the furnace's efficiency or altering the arrangement of the furnace components.

These and other objects of the present invention are attained by utilizing at least one auxiliary port in each heat exchanger of a heat exchanger assembly for a combustion system. For example, if the heat exchanger assembly comprises a plurality of side by side heat exchangers each having a single inlet for an inshot burner then an auxiliary port may be located just above each burner inlet. Also, a coupling chamber may be located over the auxiliary ports to interconnect the ports to allow acoustical coupling between the heat exchangers and to substantially prevent potential fluid flow between the heat exchangers and the surroundings of the combustion system.

BRIEF DESCRIPTION OF THE DRAWINGS

Other objects and advantages of the present invention will be apparent from the following detailed description in conjunction with the accompanying drawings, wherein like reference numerals identify like elements, and in which.

DESCRIPTION OF THE PREFERRED EMBODIMENT

Figure 1:
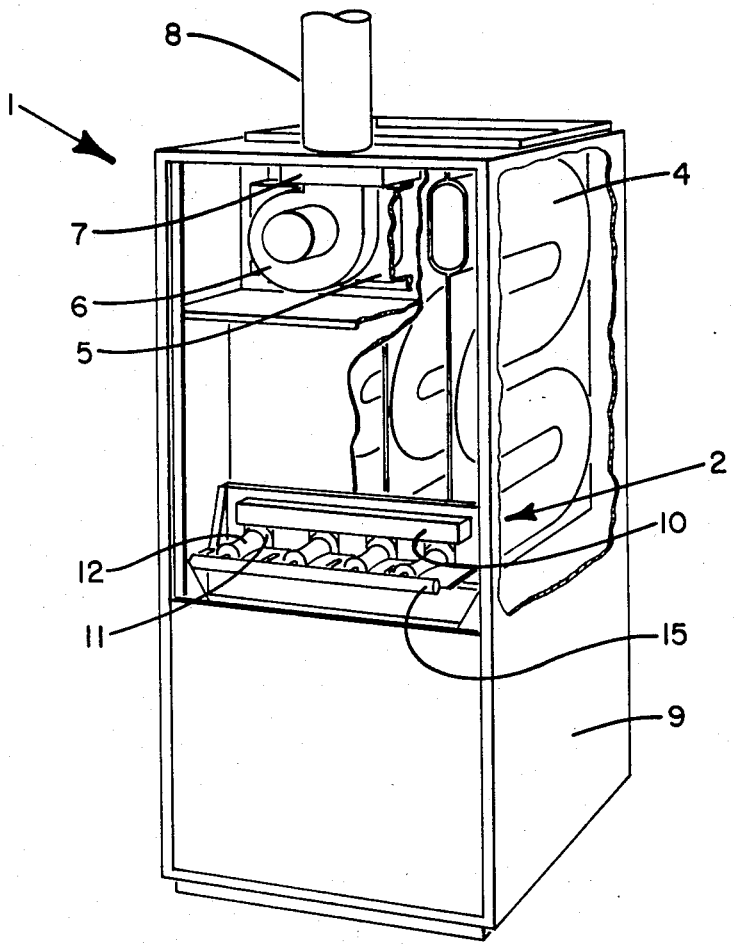
FIG. 1 shows an induced draft combustion furnace having a heat exchanger assembly in accordance with the principles of the present invention.

Referring to FIG. 1, an induced draft combustion furnace 1 having a heat exchanger assembly (system of combustion chambers) 2 in accordance with the principles of the present invention, is shown. As shown in FIG. 1, the furnace 1 includes inshot burners 12, heat exchangers 4, a flue gas collection chamber 5, a fan unit 6, a flue gas discharge box 7, and a flue pipe 8, all of which are housed in a furnace cabinet 9. Fuel is supplied from a fuel supply line 15 to each of the inshot burners 12 which, in turn, supplies the fuel to each of the burner inlets 11 in the heat exchangers 4. Also, air is drawn into the burners 12, and into the burner inlets 11, and mixed with the fuel. This air-fuel mixture is ignited by a pilot flame (not shown) and burned to produce hot gaseous products of combustion which are drawn through the heat exchangers 4 by fan unit 6 and collected in the flue gas collection chamber 5. The fan unit 6 supplies the products of combustion from the chamber 5 to the flue gas discharge box 7 from which the products of combustion flow to flue pipe 8 which discharges them from the furnace 1.

Figure 2:
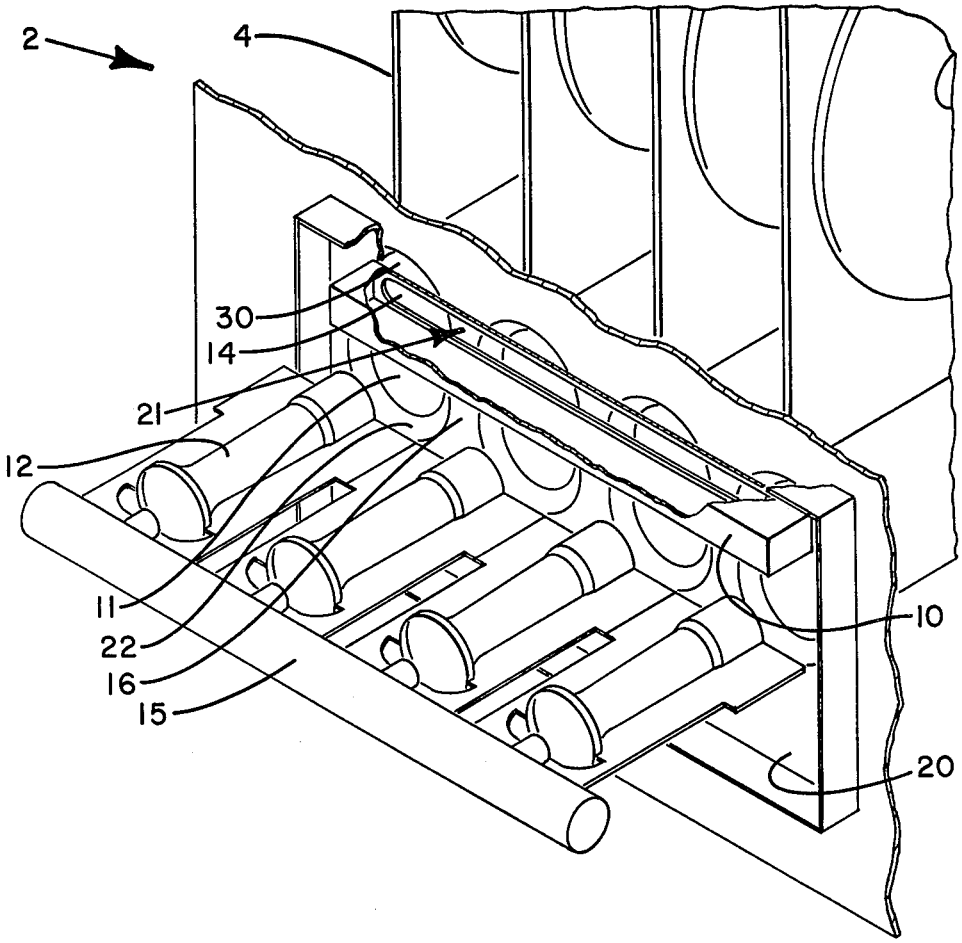
FIG. 2 is a detailed view of the burner section of the heat exchangers which are part of the heat exchanger assembly shown in FIG. 1.

Referring to FIG. 2, a detailed view is shown of the burner section of the heat exchangers 4 which are part of the heat exchanger assembly 2 of the furnace 1 shown in FIG. 1. The heat exchanger assembly 2 of the furnace 1 includes heat exchangers 4, inshot burners 12, and a rectangular coupling chamber 10. Also, as shown in FIG. 2, there is a plurality of auxiliary ports 14, with a single port 14 located just above each burner inlet 11, for reducing the overall sound level generated when operating the furnace 1. If desired, it is possible to have more than one auxiliary port 14 in each heat exchanger 4. For example, an overall sound level reduction has been observed with a test furnace having one auxiliary port located just above each burner inlet and another auxiliary port located just below each burner inlet.

As shown by FIGS. 1 and 2, the auxiliary ports 14 are interconnected by the rectangular coupling chamber 10 to allow acoustical coupling between the heat exchangers 4 and to substantially prevent potential fluid flow between the heat exchangers 4 and the surroundings of the furnace 1. Although the use of the coupling chamber 10 with the auxiliary ports 14 does provide a reduction in the overall sound level generated when operating the furnace 1, it should be noted that use of the coupling chamber 10 is not required because the auxiliary ports 14 alone will provide a reduction in the overall sound level generated when operating the furnace 1. However, the use of the coupling chamber 10 with the auxiliary ports 14 is preferable over having only auxiliary ports 14 since the coupling chamber 10 prevents escape of products of combustion from the heat exchangers 4 to the atmosphere surrounding the furnace 1 and prevents the influx of uncontrolled amounts of surrounding air into the heat exchangers 4 which could affect the combustion process at the burner inlets 11 and combustion efficiency of the furnace 1.

FIG. 2 also shows one convenient way of forming the auxiliary ports 14 in the heat exchangers 4. As shown in FIG. 2, the burners 12 are attached to a sheet metal plate 20 having a slot 21 in the top part of the plate 20 and having a series of circular openings 22 in the center part of the plate 20. There is an opening 22 for each burner 12, and each burner 12 faces its corresponding opening 22. There is an oblong opening 30 at the entrance to each of the heat exchangers 4 and the heat exchangers 4 are joined together by a webbing 16 between each of the heat exchangers 4. The circular openings 22 and the slot 21 in the plate 20 are sized to fit over the oblong openings 30 in the heat exchangers 4 to form the burner inlets 11 and auxiliary ports 14 at the interface of the plate 20 and the webbing 16 as shown in FIG. 2. Of course, the auxiliary ports 14 may be formed in any of a variety of ways and the foregoing is only one way of forming the ports 14. For example, in a different situation all that may be required is to punch a hole in each of the heat exchangers 4 near each of the burner inlets 11.

No proven technical explanation is known for why the auxiliary ports 14 reduce the overall sound level generated during operation of the furnace 1 or for why the use of the coupling chamber 10 with the auxiliary ports 14 also reduces this generated sound level. The auxiliary ports 14 may allow acoustic waves to escape from the heat exchangers 4 and to dissipate before significant amplification of the acoustic waves can occur in the heat exchangers 4. Alternatively, the auxiliary ports 14 may alter the air-fuel flow pattern at the source of combustion to reduce turbulence thereby reducing the amount of combustion noise generated by the combustion process. In addition, the use of the coupling chamber 10 may produce an acoustic wave cancellation effect. That is, out of phase acoustical waves traveling between the heat exchangers 4 may cancel each other out. However, these are only possible theories of operation which have not been proven by detailed scientific studies.

Although no proven technical explanation is known for the overall sound level reductions, measurable sound level reductions have been observed with an induced draft combustion furnace having a heat exchanger assembly 2 with auxiliary ports 14 as previously described. Actual tests were conducted with an induced draft combustion furnace having four, side by side, "S-shaped" heat exchangers, each with a monoport, inshot burner facing a circular burner inlet which is approximately 1.5 inches (3.81 centimeters) in diameter. A fan unit, located in a flue gas collection chamber above the heat exchangers, draws the products of combustion through the heat exchangers.

Figure 3:
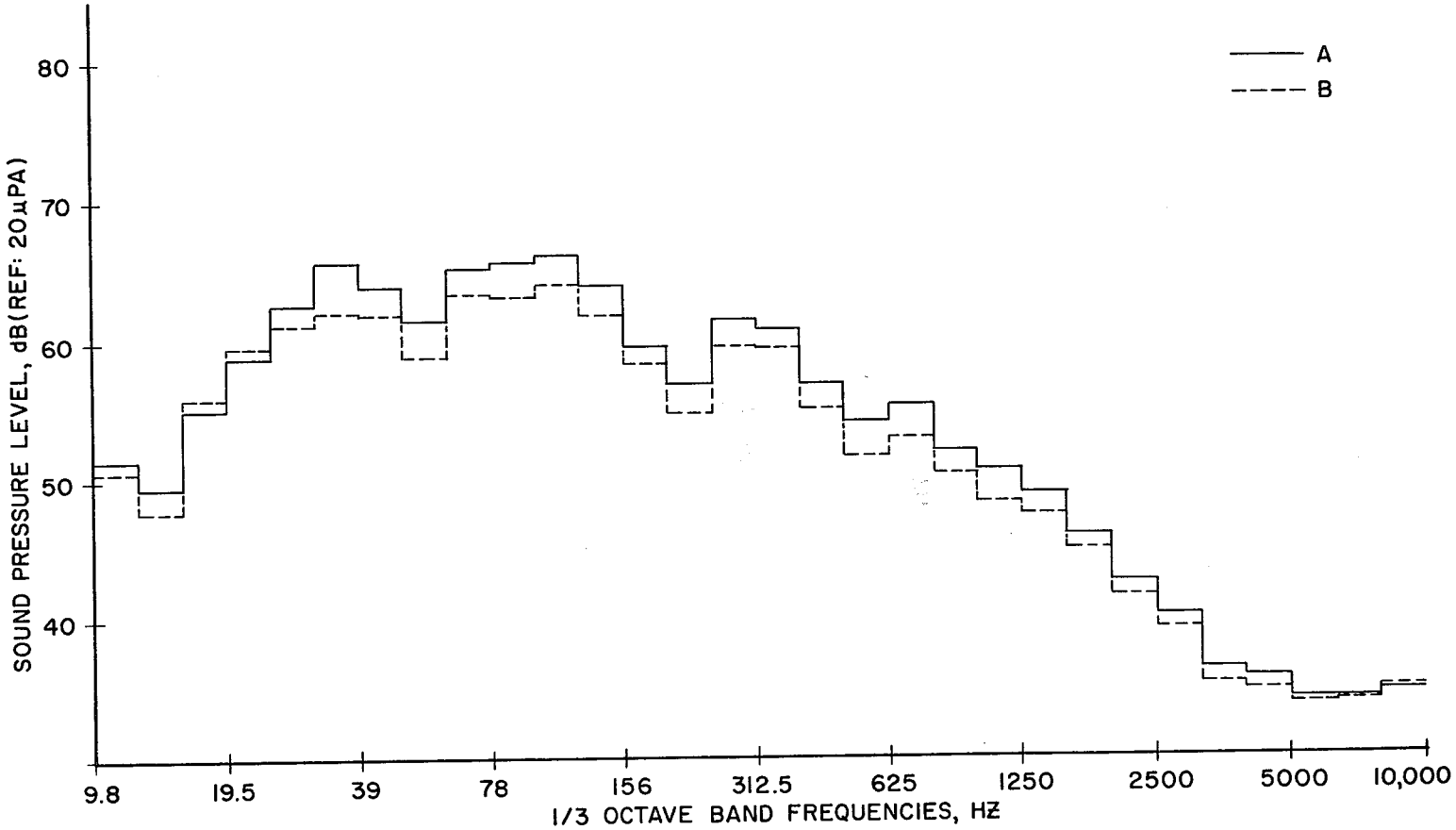
FIG. 3 is a graph illustrating actual test results obtained with an induced draft furnace having heat exchangers with no auxiliary ports, and with auxiliary ports interconnected by a coupling chamber. Each curve of the graph is a plot of measured sound pressure level in decibels versus frequency in one-third octave bands.

The above described furnace was tested in a "sound room" isolated from extraneous noise to provide a relatively low level of background noise. A conventional microphone system with pre-amplifier electrically connected to a conventional sound level monitoring and analyzing system were used to obtain the sound data. Several tests were conducted with auxiliary ports and rectangular coupling chambers of various sizes, shapes, and locations. The results of these tests may be generally summarized by referring to FIG. 3 which is a graph of measured sound pressure level in decibels versus one-third octave frequency bands from approximately 10 to 10,000 hertz. The top curve A shown in FIG. 3 is the sound level measured during operation of a furnace without any auxiliary ports and without a coupling chamber. The bottom curve B is the sound level measured during operation of a furnace with oblong, approximately $\frac{5}{8}$ inch by 1.5 inches (1.59 centimeters by 3.81 centimeters), auxiliary ports interconnected by a rectangular coupling chamber approximately $\frac{3}{4}$ of an inch (1.91 centimeters) wide and 1 inch (2.54 centimeters) deep. The center of each auxiliary port was approximately $1\frac{5}{8}$ inches (4.13 centimeters) above the center of each burner inlet. As shown by the graph of FIG. 3, relative to a furnace with no auxiliary ports, an overall sound level reduction is achieved with a furnace having auxiliary ports and a coupling chamber.

Generally, the graph shown in FIG. 3 is representative of the test results obtained with respect to the overall effects of modifying an induced draft furnace to incorporate auxiliary ports with a coupling chamber. However, it should be noted that numerous tests were run under widely varying conditions and, of course, every test did not show exactly the same results. For example, some field tests showed less reduction in overall sound level when using auxiliary ports with a coupling chamber as compared to the reduction illustrated in FIG. 3. However, "sound room" data is considered more consistent than field data and uncontrollable field conditions, such as background noise, probably account for these results. With this background in mind, it should be understood that the curves shown in FIG. 3 are for illustrative purposes only and these curves may not always represent actual sound levels which might be measured in a particular field situation due to the varied nature of field conditions.

Figure 4:
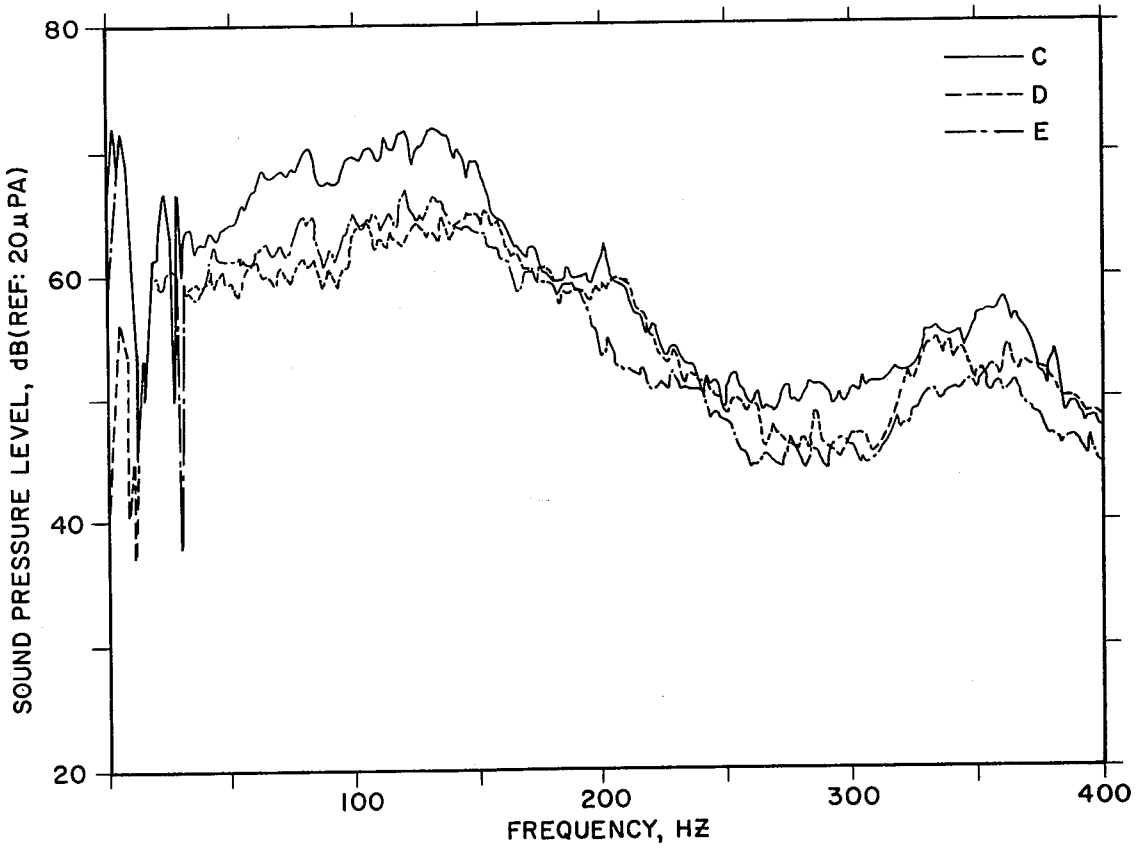
FIG. 4 is a graph illustrating actual test results obtained with an induced draft furnace having heat exchangers with no auxiliary ports, with two auxiliary ports in each heat exchanger, and with two auxiliary ports in each heat exchanger positioned relative to the auxiliary ports in the other heat exchangers to form two groups of ports each of which is interconnected by a coupling chamber. Each curve of the graph is a plot of measured sound pressure level in decibels versus frequency.

FIG. 4 is a graph illustrating actual "sound room" test results obtained with another induced draft furnace of the kind described above under somewhat different test conditions. Each curve is a plot of sound pressure level in decibels versus frequency from zero to 400 hertz. The upper curve C shown in FIG. 4 is the sound pressure level measured during operation of the furnace without auxiliary ports and coupling chamber. The first lower curve D is the sound pressure level measured during operation of the furnace with two, approximately one-inch (2.54 centimeters) diameter, circular auxiliary ports in each heat exchanger of the furnace. In each heat exchanger, one auxiliary port was located with its center approximately $1\frac{5}{8}$ inches (4.13 centimeters) directly above the center of the burner inlet to the heat exchanger and the other auxiliary port was located with its center approximately $1\frac{5}{8}$ inches (4.13 centimeters) directly below the center of the burner inlet to the heat exchanger. The other lower curve E is the sound pressure level measured during operation of the furnace with two, approximately one-inch (2.54 centimeters) diameter, circular auxiliary ports in each heat exchanger as described above, and with two, approximately one-inch (2.54 centimeters) by one inch (2.54 centimeters) rectangular coupling chambers interconnecting two groups of these auxiliary ports. Namely, one coupling chamber was used to interconnect the auxiliary ports located above the burner inlets and the second coupling chamber was used to interconnect the auxilliary ports located below the burner inlets.

As may be seen by referring to FIG. 4, the use of just the auxiliary ports resulted in an overall sound level reduction relative to the sound levels measured for the furnace without auxiliary ports. Also, the use of the coupling chambers with the auxiliary ports resulted in an overall sound level reduction. Again, it should be understood that FIG. 4 is presented to illustrate the overall trend of many test results and should not be taken to mean that all tests which might be conducted will provide these same particular results.

In addition to the general effects described above, the tests indicated that the overall sound level generated by the furnace depends on the size (cross-sectional area) of the auxiliary ports. Larger ports were found to reduce the overall sound level more than smaller ports. Generally, based on the tests conducted, it was observed that the best overall sound level reduction was obtained when the size of each of the auxiliary ports was somewhat smaller than the size of each of the burner inlets. Also, it should be noted that the tests indicated that overall sound level will vary depending on the dimensions of the rectangular coupling chamber. Specifically, based on the coupling chambers tested, it appears that a rectangular coupling chamber having a depth equal to or greater than its width provides the most reduction in overall sound level.

Finally, it should be noted that while the present invention has been described in conjunction with a particular embodiment it is to be understood that various modifications and other embodiments of the present invention may be made without departing from the scope of the invention as described herein and as claimed in the appended claims.

What is claimed is:

1. A noise reducing heat exchanger assembly for a combustion system comprising:

a plurality of side-by-side heat exchangers, each heat exchanger having a bottom part with an inshot burner inlet wherein combustion may occur and a top part for conducting products of combustion away from the bottom part of the heat exchanger, said inshot burner inlets located relative to each other to provide a series of side-by-side inshot burner inlets;

an inshot burner spaced from and facing each inshot burner inlet opening to project a combustion flame into each inshot burner inlet;

an auxiliary port located adjacent to each inshot burner inlet in the bottom part of each heat exchanger and located relative to each other to form a series of side-by-side auxiliary ports;

a chamber interconnecting only the auxiliary ports to allow acoustical coupling between the heat exchangers, said chamber closed off from ambient to substantially prevent the escape of products of combustion from the chamber and to substantially prevent the influx of surrounding air through the chamber into the heat exchangers; and inducer means for drawing products of combustion through each of the heat exchangers from the bottom part to the top part of each heat exchanger.

2. A noise reducing heat exchanger assembly for a combustion system as recited in claim 1 wherein said chamber interconnecting only the auxiliary ports comprises:

a substantially rectangular box having a depth equal to or greater than its width.

3. A noise reducing heat exchanger assembly for a combustion system as recited in claim 1 wherein the inducer means comprises:

a flue gas collection chamber for collecting the products of combustion from the top parts of the heat exchangers; and a fan unit connected to the flue gas collection chamber to draw the products of combustion from the heat exchangers into the flue gas collection chamber.

* * * * *